United States Patent [19]

Scherzinger et al.

[11] Patent Number: 4,888,963

[45] Date of Patent: Dec. 26, 1989

[54] CIRCULAR KNITTING MACHINE

[75] Inventors: Werner Scherzinger, Bisingen; Paul Neher, Messsteteen, both of Fed. Rep. of Germany

[73] Assignees: SIPRA Patententwicklungs, Albstadt; Beteiligungsgesellschaft mbH, Tailfingen, both of Fed. Rep. of Germany

[21] Appl. No.: 201,114

[22] Filed: May 27, 1988

[30] Foreign Application Priority Data

Jun. 4, 1987 [DE] Fed. Rep. of Germany ..... 3718659

[51] Int. Cl.[4] ..... D04B 15/88; D04B 35/34

[52] U.S. Cl. ..... 66/151

[58] Field of Search ..... 66/147, 149 R, 151

[56] References Cited

U.S. PATENT DOCUMENTS

| | | | |
|---|---|---|---|
| 3,269,150 | 8/1966 | Haehnel | 66/149 R |
| 3,839,885 | 10/1974 | Bourgeois | 66/151 |
| 3,872,692 | 3/1975 | Miyagawa et al. | 66/151 |
| 4,036,266 | 7/1977 | Gsell et al. | 66/149 R |
| 4,079,600 | 3/1978 | Amaya et al. | 66/151 X |
| 4,765,155 | 8/1988 | Pernick | 66/151 X |

FOREIGN PATENT DOCUMENTS

| | | | |
|---|---|---|---|
| 2005141 | 8/1971 | Fed. Rep. of Germany | 66/151 |
| 216962 | 12/1984 | Japan | 66/147 |
| 15367 | 1/1987 | Japan | 66/147 |

*Primary Examiner*—Wm. Carter Reynolds

*Attorney, Agent, or Firm*—Michael J. Striker

[57] ABSTRACT

A circular knitting machine has a rotatable needle cylinder, a supporting plate rotating synchronously with the needle cylinder, and a product drawing off and winding device. The device includes a roll bar arranged to support a product roll and provided with a bearing part which is displaceable for arranging a finished product roll, a roll bar magazine for supplying roll bars to the bearing part, a drawing off roller, a cutting unit movable substantially parallel to the drawing off roller, a drive unit for driving the roll bar and having a drive shaft which abuts against a product roll and turns parallel thereto. The bearing part has a bearing support which is turnable for ejecting a product roll and has an open fork-shaped bearing trough supporting ends of the roll bar. A guiding element is articulately connected with the supporting plate and extends inclinedly downwardly til over the roll bar outwardly. The guiding element extends over a whole width of a product roll and abuts with a pre-stress against the latter. It is freely turnable til the supporting plate.

19 Claims, 4 Drawing Sheets

CIRCULAR KNITTING MACHINE

BACKGROUND OF THE INVENTION

The present inention relates to a circular knitting machine, or particularly to its product drawing off and winding device with a rotatable needle cylinder, with a supporting plate which is provided for the product drawing off device and the product winding device and rotates synchronously with the needle cylinder, with a displaceable bearing part for bringing a finished product roll and provided for supporting a roll bar, with a roll bar magazine for supplying the roll bars to the bearing part, with a cutting device having a rotatable cutter and displaceable parallel to a product drawing off roller, and with a control device for an automatic performance of a roll formation and a roll bar exchange.

Arrangements of the above mentioned general type are known in the art. One of such arrangements is disclosed, for example, in the German document DE-OS 2,005,141. The known product drawing off and winding devices for circular knitting machines have several disadvantages which include, first of all, a complicated construction of the device and as a result of this special structural features which have to be taken care on installation places of the circular knitting machine for withdrawing a completed product roll from the machine. Problematic is also with this machine the secure engagement of the initial portion of the knitting hose in the winding device by a newly introduced roll bar.

For this reason the product drawing off and winding devices cannot be provided with an automatic roll bar exchange.

SUMMARY OF THE INVENTION

Accordingly, it is an object of the present invention to provide a product drawing off and winding device for a circular knitting machine of the above mentioned general type, which with structurally simple means and in a spacesaving manner operate with an automatic exchange of roll bars and in an operationally safe way.

In keeping with these objects and with others which will become apparent hereinafter, one feature of the present invention resides, briefly stated, in a product drawing off and winding device in which a drive of a roll bar is performed in a known manner by means of a drive shaft which abuts against a product roll and is displaceable parallel thereto, in a bearing part the ends of the roll bar rest in open fork-shaped bearing troughs of a bearing support which is turnable for ejecting the product roll by a control device, and a guiding element is articulated with and extends inclinedly from a rotatable supporting plate upwardly til beyond the roll bar and over the whole width of the product roll to abut against the product roll with a prestress, so that the guiding element can be turned freely toward the supporting plate.

With the use of the known friction roll drive of the product roll, expensive drive couplings in the bearing support for the ends of the roll bar are dispensed with. From the fork-shaped open bearing troughs, a finished product roll can be released by simple turning of the bearing supports and roll onto a carriage provided for example in front of the circular knitting machine. Advantageously a bent end region of the guiding element which is turnable from the ejected product roll to the supporting plate can form a discharging ramp for the product roll. The turnable support of the guiding element under the product roll on the supporting plate has the advantage as compared with known guiding elements located above the product roll, in that the space between the product drawing off device and the product winding device remains freely accessible or is available for other auxiliary devices, and the turning space required for the guiding element is provided in the bottom region of the frame of the circular knitting machine.

The knitting hose-inlet region of the product winding device is visible and not covered with the guiding element. If difficulties occur at the starting portion of the roll, the inlet region is freely accessible.

The product winding device formed in accordance with the present invention has the advantage that it more reliably engages the initial portion of the knitting hose. This operational safety can be increased, for example, in that the guiding element is provided in its end regions with an adjustable sliding pin for supporting the guiding element on the roll bar so as to provide an average distance from the roll bar without a product roll, which facilitates introduction of the initial portion of the knitting hose along the guiding element till the acting region of the roll bar. The roll bar can be provided with known product entraining needles.

Additionally, the winding of the knitting hose on a new roll bar is improved in accordance with the present invention in that the drive shaft for the product roll has in its end regions at least one concentrically arranged friction ring. The friction rings reach an abutment against the roll-free end regions of the roll bar. Their height corresponds to at least the length of the product entraining needles which are extendable from the roll bar. By this friction ring, not only collision of the drive shaft with the product entraining needles is prevented, but also the roll bar obtains a greater rotary speed than during later abutment of the drive shaft against the forming product roll. By this increased initial rotary speed of the roll bar a more accurate start of winding is insured also for the case when the initial portion of the knitting hose must be first engaged after a complete initial piece of the knitting hose is stopped on the guiding element.

For the sake of structural simplicity of the product drawing off and winding device for an automatic roll bar exchange, in accordance with the present invention the securing of the roll bar in the bearing troughs of both bearing supports can be performed in an advantageous manner by means of the bearing pins which are coaxially insertable in the ends of the roll bar and simultaneously serve for extending the product entraining needles against the force of at least one return spring. Advantageously, each bearing pin is arranged on an end of a two-armed turning lever which is provided at its other end with a holding projection. The holding projection during turning of the bearing pins from the roll bar extends in the turning region of the drive shaft and holds the drive shaft at a distance from the bearing part, until after ejection of a finished product roll a new roll bar is dropped from the roll bar magazine into the bearing troughs of the bearing supports. With this simply forcedly displaceable turning lever, three operational functions can be performed at the same time.

The cutting device can be formed for space saving so that it is provided with a shaft which extends parallel to the last product drawing off roller of the product drawing off device and a support bar which extends parallel to the shaft, while for known cutting devices for flatly lying knitting hoses a blocking and easily contaminating chain drive is required. The cutting device in accordance with the present invention can be displaceable together with an electric drive rotor for the disc cutter by means of a roll ring traversing drive on a shaft which extends parallel to the drawing rollers. The current can be supplied to the drive motor through a sliding contact which cooperates with a contact path formed by a supporting rod extending parallel to the shaft.

In accordance with the present invention, the product withdrawing region is provided for safety reasons with a grating-shaped or wall-shaped shielding element. A part of the shielding element can be formed as an ejection gate for the product rolls and move on guide rods or rails by means of a motor which is controlled by a control device. Advantageously, the shielding element is arranged on vertical guide rods and displace upwardly in a space economical manner. The guide rods can simultaneously be formed as turning axes for the shielding element in its normal position, which by its turning can make the shielded space available.

The control device of the inventive product drawing off and winding device can include an electrical evaluating circuit which in dependence on a loading condition of the roll bar magazine, activates the speed of the needle cylinder drive and at least in dependence on the position of the bearing part of the roll bar or in dependence on the filling degree of the roll bar magazine, activates the stoppage of the machine, and the successive steps of the automatic roll bar exchange is monitored by the control device with the stopped machine. The control device can be provided with a sensor which senses the weight or the outer periphery of the product roll.

The control device can perform automatic replacement of a finished product roll with an empty roll bar. In accordance with the present invention the method is proposed for this automatic replacement. The method includes the following steps: (a) switching a machine drive after producing a product roll to a creeping step and turning off of the machine drive after reaching an ejection position before an ejection gate of a frame of the circular knitting machine; (b) actuating product cutting means, releasing roll bar ends by bearing pins with withdrawing product entraining needles of the roll bar and bringing a holding projection into a turning region of a drive shaft, and simultaneously displacing a shielding element for forming the ejecting gate; (c) turning the bearing pins til the product roll rolls off from opened bearing troughs and running the product roll over a downwardly pressed guiding element toward the ejection gate; (d) turning back the bearing pins and dropping a new roll bar from a roll bar magazine into the bearing troughs and returning the guiding element; (e) securing the new roll bar by pressing the bearing pins into the ends of the roll bar with release of the drive shaft and with extension of the product entraining needles from the roll bar; simultaneously returning the shielding element and releasing the drive shaft til abutment against the new roll bar; and (f) starting again the circular knitting machine with a slow pace til a starting portion of a knitting hose is engaged by the new roll bar, and then switching to an operational speed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
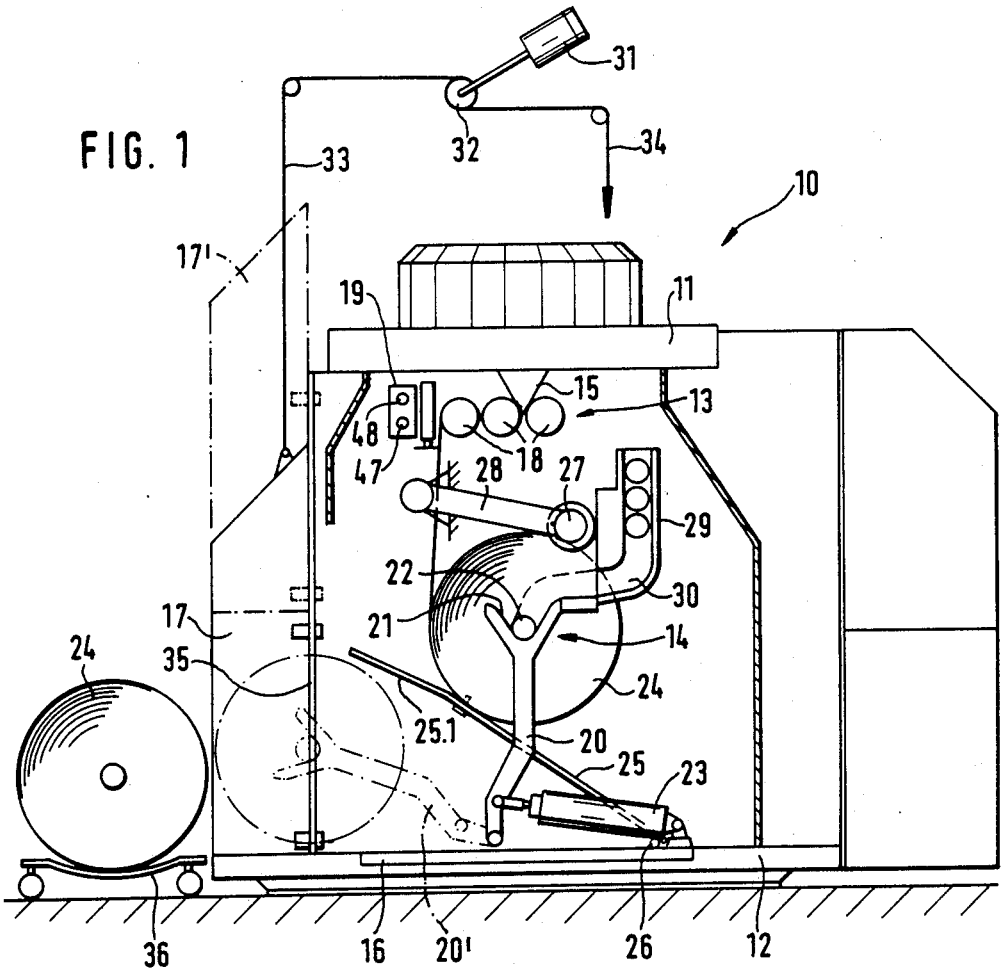
FIG. 1 is a schematic side view of a circular knitting machine with important parts of its product drawing off and winding device.

FIG. 1 schematically shows a frame of a single contour circular knitting machine 10 with a cam ring 11, a bottom plate 12 of the machine frame, and a space between the cam ring 11 and the bottom plate 12 for a drawing off device 13 and a winding device 14 for the formed rotating product hose 15. The product drawing off device 13 and the product winding device 14 are arranged in a not shown manner on a lower supporting plate 16 which is rotatably driven with the needle cylinder. The machine space which accommodates the product drawing off device and the product winding device is limited from outside by a shielding wall 17. The shielding wall 17 comprises a grating element 67 in this example. The product drawing off device 13 includes in a known manner several driven drawing off rollers 18. A material cutting device 19 is arranged movable parallel to the drawing off rollers 18.

The product winding device 14 has substantially two bearing supports 20 which end in a fork-shaped and upwardly open bearing trough 21 for the end region of a roll bar 22. They are turnable by means of a pneumatic or hydraulic cylinder-piston device 23 which can be replaced by an electromechanic device, to an ejecting position 20' for a product roll 24 formed on a roll bar 22 as shown in broken lines in FIG. 1. Further parts include a guiding element formed of a guiding sheet 25 with an outwardly bent end portion 25.1 which is supported on the rotatable supporting plate in a location 26 against a spring force. The drive of the product roll 24 is performed by means of a drive shaft 27 which abuts against the product roll and is supported between two turning arms 28. The product winding device 14 is associated with a roll bar magazine 29, from which through a roll path 30 individual new roll bars can roll into the bearing troughs 21 of the bearing support 20. The withdrawing mechanism for such a stack magazine is well known in different technical fields and therefore is not described in detail here. The arrangement is designed so that in the event of energy failure the product roll 24 will not fall from its bearing troughs.

FIG. 1 additionally shows a motor 31 which drives a rope drum 32 for winding of pulling ropes 33 and 34. With the aid of the pulling ropes 33 and 34 the shielding wall 17 which is supported on vertical guiding rods 35 or guiding rails can be pulled upwardly to a position 17' for forming an ejection gate. The guiding rods 35 serve simultaneously as turning axles for the shielding wall for manual opening in their normal position. A carriage 36 is shown before the ejecting gate of the circular knitting machine 10 so that an ejected roll 24 can be rolled on it for further transportation.

Figure 2:
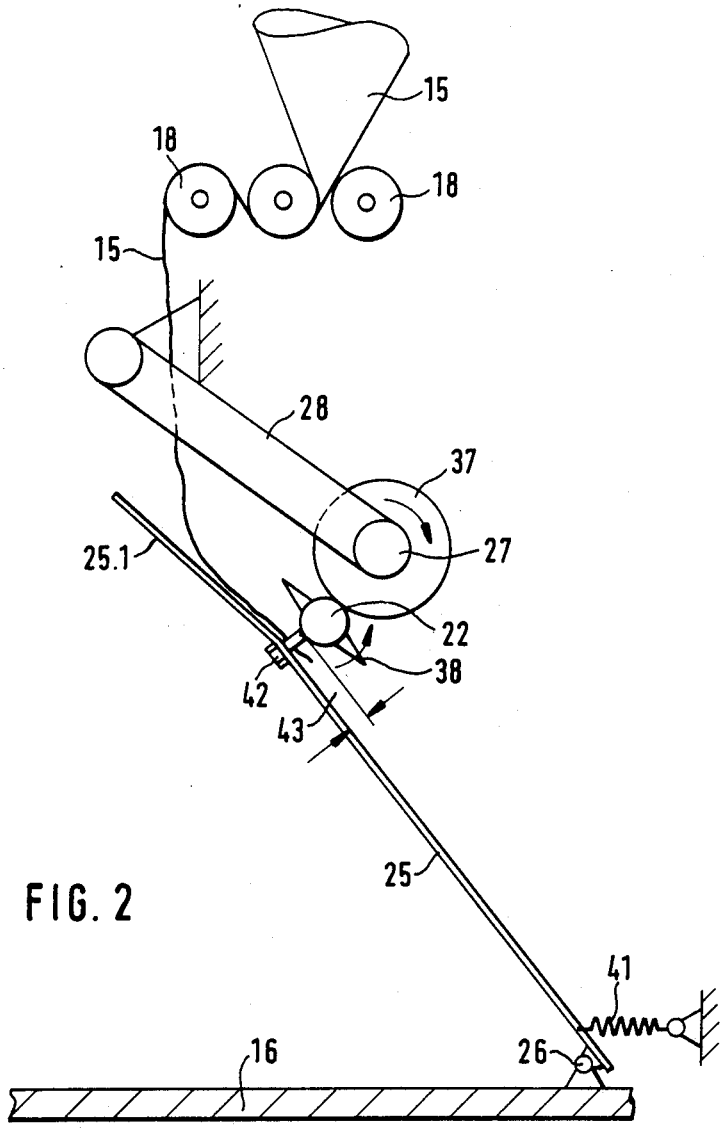
FIG. 2 is a schematic view showing a drive for a roll bar with a guiding plate in an axial direction of the roll bar.
Figure 3:
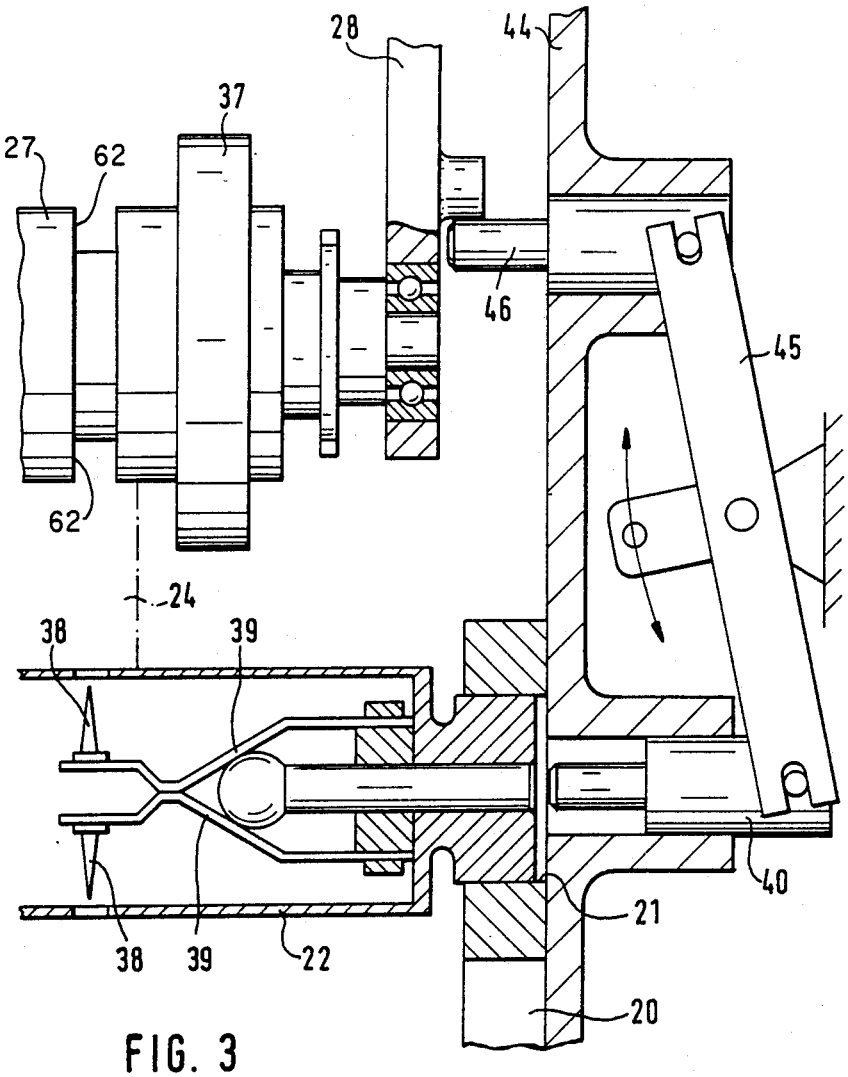
FIG. 3 is a front view of a bearing region and end region of a roll bar and a drive shaft for the product roll.

FIGS. 2 and 3 show individual details of the product winding device. The drive shaft 27 which is supported between two turning arms 28 and driven in rotation by means of a not shown drive device is provided at both ends with a coaxial friction ring 37. With the friction rings 37, the drive shaft 27 in FIG. 2 comes to abutment against an empty roll bar 22 and activates the drive of the roll bar 22 til the thickness of the forming product roll 24 is greater than the height of the friction rings 37 and thereby the drive shaft 27 comes to abutment against the product roll 24 and takes over its drive. The height of the friction ring 37 is selected so that it is somewhat greater than the length of product entraining needles 38 which are driven from the roll bar, so that the needles 28 cannot collide with the drive shaft 27. The drive shaft 27 can also be provided with peripheral grooves 62 of sufficient depth for receiving of product entraining needles 38 which are driven from the roll bar 22. The product entraining needles 38 are mounted on spring tongues 39 arranged in the interior of the roll bar 22 as shown in FIG. 3. The spring tongues 39 are spreadable by means of a bearing pin 40 which is insertable in the end of the roll bar 22 and simultaneously secures the roll bar 22 in the bearing trough 21, for moving the product entraining needles 38 out of the openings of the roll bar 22.

FIG. 2 shows a return spring 41 for the guiding sheet 25. The guiding sheet 25 is provided in its both end edge regions with sliding pins 42 which come to abutment against the empty roll bar 22 and are secured in an inlet gap 43 between the guiding sheet and the roll bar 22.

As can be seen from FIG. 3, the bearing pin 40 is supported in a supporting frame wall 44 and articulately connected with one end of a double-armed turning lever 45. The latter can perform a turning movement in one or another direction by means of a not shown drive. The other end of two-armed turning lever 45 is pivotally connected with a return projection 46 which is also longitudinally displaceably supported in the supporting frame wall 44. The return projection 46 in its extended position shown in FIG. 3 extends to the region of the turning arm 28 for the drive shaft 27. FIG. 3 shows the two-armed turning lever 45 in a position in which the bearing pin 40 is withdrawn from the roll bar 22, so that the bearing support 40 is withdrawn from the roll bar 22 so that the bearing support can be turned or ejecting the product roll 24. By the return projection 46, the drive shaft 27 is restrained during turning to the region of the bearing trough 21 after the expelling of the roll 24. An unlocking of the drive shaft 27 is performed when by a return turning movement of the double-armed turning lever 45, the bearing pin 40 is inserted into the end of a newly produced roll bar 22. Then the friction ring 37 comes to abutment against the new roll bar 22.

Figure 4:
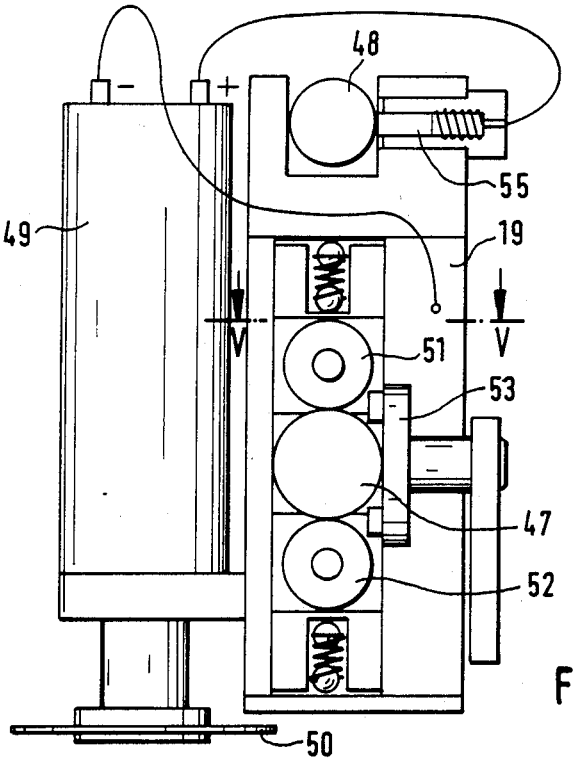
FIG. 4 is a view showing a cutting device of the circular knitting machine of the invention.
Figure 5:
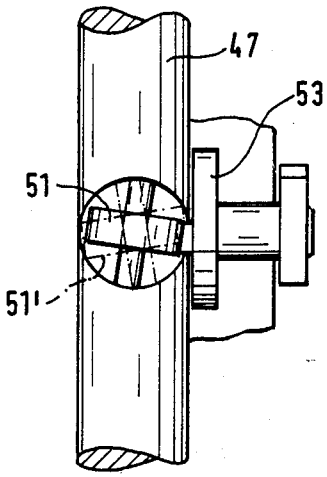
FIG. 5 is a view showing a section taken along the line V—V in FIG. 4.

FIGS. 4 and 5 show the cutting device 19 which is associated with the product drawing off device for cutting the flatly lying knitting hose 15 after the finished position of a product roll and before its injection. The cutting device is displaced with its housing over a driven shaft 47 and runs parallel to the drawing off rollers 18 of the drawing off device 13. It is supported on a supporting rod 48 which extends parallel to the shaft 47. The housing carries an electric drive motor 49 or a disc cutter 50. The longitudinal movement of the cutting device 19 on the driving shaft 47 is performed by means of a traversing drive which has two rollers 51 and 52 arranged inclinedly to the shaft 47. The rollers are turnably supported in a housing by a turning lever 53. By displacing the turning lever 53, the longitudinal movement direction for the cutting device 19 can be reversed. The running rollers 51 and 52 can be placed into a respective inclined position, for example 51', to the shaft 47. The current supply of the electric motor 49 is performed via the isolated supporting rod 48. A sliding brush 55 is in engagement with the supporting rod 48.

The arrangement is provided with a control device which, for example, has a sensor responsive to the weight of the forming product roll 24. After reaching a predetermined product roll weight, the roll bar exchange is performed. This can be also performed by a diameter sensing of the product roll. The turnable drive shaft 27 can also cooperate with a roll switch in minimum and maximum turning position.

The operation of the product drawing off and winding device during automatic exchange of the roll bar after the manufacture of a product roll under the action of a not shown control device is performed in the following manner.

When an empty roll bar 22 falls from the roll bar magazine 29 into the upwardly open bearing trough 21 of the bearing support 20, the two-armed turning lever 45 is turned from the position shown in FIG. 3 in a clockwise direction, so that the return or hold projection 46 of the turning arm 28 is released for the drive shaft 27 and the bearing pin 40 by insertion in the end of the roll bar 22 secures the roll bar in the bearing trough 21. Simultaneously, the product entraining needles 38 are driven out of the roll bar 22. The circular knitting machine starts running in a slow process. The product drawing off device 13 transports the formed product hose 15 flatly downwardly, when its initial portion meets the guiding sheet 25 assuming the position shown in FIG. 2 and slides into the gap 43 formed between the guiding sheet 25 and the roll bar 22. Then the flatly lying knitting hose 15 is engaged by the product entraining needles 38 of the roll bar 22 which is driven through the friction ring 37 somewhat faster than the supply speed of the knitting product hose 15. As long as the forming of product roll 24 reaches a height which exceeds the height of the product entraining needles 38 and the height of the friction ring 37, the drive shaft 27 comes to abutment against the product roll 24 and takes over its drive synchronously with the supply speed of the knitting hose 15. The guiding sheet 25 reaches the abutment against the product roll 24.

When the product roll reaches a desired diameter or carries a predetermined product web length, the drive of the circular knitting machine is switched to a creeping process by the control device and completely switched off when the product roll in the creeping process reaches an ejection position. Then the two-armed turning lever 45 is turned to its position shown in FIG. 3 for unlocking the roll bar ends, the shaft 47 for the cutting device 19 is driven, and thereby the flatly lying knitting hose 15 is separated behind the last drawing off roller 18 of the drawing off device 13. By means of the motor 31 the shielding wall 17 is pulled upwardly for forming the ejecting gate. After these steps both bearing supports 20 are turned by means of the driving device 23 to the position 20' shown in FIG. 1 so that the product roll 24 falls from the bearing trough 21 and rolls out through the ejecting gate onto the carriage 36. Then rolling of the product roll 24 over the bent end region 25.1 of the guiding sheet 25 turned to the supporting plate 16 is performed. The cut off end region of the knitting hose falls on the guiding sheet 25 is rolled on the product roll 24. After returned turning of the bearing support 20, a new empty roll bar 22 is brought from the roll bar magazine 29 to the bearing trough 21 and by return turning of the two-armed lever 45 is locked in the bearing position. Simultaneously, the ejection gate on the machine frame is closed again by lowering of the shielding wall 17. Now a new start of the circular knitting machine begins with slow process. As long as the knitting hose 19 is wound on the new roll bar, it is switched from the slow process to the normal operational speed.

It will be understood that each of the elements described above, or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A circular knitting machine, comprising, a rotatable needle cylinder; a supporting plate rotating synchronously with said needle cylinder; and a product drawing off and winding device, said device including a roll bar arranged to support a product roll and provided with a bearing part which is displaceable for arranging a finished product roll, a roll bar magazine for supplying roll bars to said bearing part, a drawing off roller, cutting means movable substantially parallel to said drawing off roller, drive means for driving said roll bar and including a drive shaft which abuts against a product roll and turns parallel thereto, said bearing part including a bearing support which is turnable for ejecting a product roll and has an open fork-shaped bearing trough for supporting ends of said roll bar, and a guiding element which is articulately connected with said supporting plate and extends inclinedly upwardly and outwardly relative to said roll bar outwardly, said guiding element extending over a whole width of a product roll and abutting with a pre-stress against the latter, said guiding element being freely turnable down to said supporting plate.

2. A circular knitting machine as defined in claim 1, wherein said cutting means includes a rotatable cutter.

3. A circular knitting machine as defined in claim 1, wherein said guiding element has side regions and is provided in each of said side regions with an adjustable sliding pin for supporting said guiding element against said roll bar for forming an average distance from said roll bar when the latter is without a product roll.

4. A circular knitting machine as defined in claim 1, wherein said drive shaft has end regions and is provided in said end regions with at least one concentrically arranged friction ring which comes to abutment against an end region of said roll bar when it is free of a product roll, said roll bar being provided with product entraining needles having a predetermined length, said friction ring having a height which at least corresponds to the length of said product entraining needles.

5. A circular knitting machine as defined in claim 1, wherein said roll bar has product entraining needles, said drive shaft being provided with peripheral grooves having a depth sufficient for receiving said product entraining needles.

6. A circular knitting machine as defined in claim 1, wherein said device has a second such bearing support with a second such bearing trough, and means for securing said roll bar in said bearing troughs of both said bearing supports, said roll bar being provided with a plurality of product entraining needles, said securing means including coaxially insertable bearing pins which act for extending said product entraining needles against a spring force.

7. A circular knitting machine as defined in claim 6, wherein said device further including a return spring which provides said force against which said bearing pins extend said product entraining needles.

8. A circular knitting machine as defined in claim 6, wherein said device further has a two-armed drivable turning lever, each of said bearing pins being arranged on one end of said turning lever, the other end of said turning lever being provided with a holding projection which extends into a turning region of said drive shaft when said bearing pins are turned out of said roll bar.

9. A circular knitting machine as defined in claim 1, wherein said guiding element has a free end region which is bent outwardly so that when said guiding element is turned to said supporting plate said free end region forms an inclined plane for a product roll to eject the latter.

10. A circular knitting machine as defined in claim 1; and further comprising shielding means including a shielding element which for forming an ejection gate is supported in a displaceable manner between an ejecting position in which it forms an ejection gate for ejecting a finished product roll and a shielding position in which it closes said ejection gate.

11. A circular knitting machine as defined in claim 10, wherein said shielding element is formed as a grating element.

12. A circular knitting machine as defined in claim 10, wherein said shielding element is formed as a wall element.

13. A circular knitting machine as defined in claim 10, wherein said ejecting means further includes a guide on which said shielding element is displaceable and a motor which displaces said shielding element on said guide.

14. A circular knitting machine as defined in claim 13, wherein said guide includes guiding rods on which said shielding element is displaceable.

15. A circular knitting machine as defined in claim 14, wherein said guide is formed as guiding rails on which said shielding element is displaceable.

16. A circular knitting machine as defined in claim 10; and further comprising vertical guiding rods on which said shielding element is arranged in a vertically displaceable manner and which simultaneously form turning axes for said shielding element.

17. A circular knitting machine as defined in claim 1, wherein said cutting means includes a disc cutter, a drive motor for driving said disc cutter, and means for supplying a current to said drive motor and including a contact path and a sliding contact cooperating with said contact path.

18. A circular knitting machine as defined in claim 17, wherein said device further has a plurality of drawing off rollers, and means for transverse displacing said cutting means, said transverse displacing means including a driven shaft extending parallel to said drawing off rollers and supporting said cutting means, and a roll ring traversing drive arranged for transversely displacing said cutting means, said contact path being formed as a supporting rod which extends parallel to said driven shaft.

19. A method of automatic replacement of a finished product roll by an empty roll bar in a circular knitting machine with a product drawing off and winding device, comprising the steps of switching a machine drive after producing a product roll to a creeping step and turning off of the machine drive after reaching an ejection position before an ejection gate of a frame of the circular knitting machine; actuating product cutting means, releasing roll bar ends by bearing pins with withdrawing of product entraining needles of the roll bar and bringing a holding projection into a turning region of a drive shaft, and simultaneously displacing a shielding element for forming the ejecting gate; turning the bearing pins til the product roll falls from opened bearing troughs and running the product roll over a downwardly pressed guiding element toward the ejection gate; turning back the bearing pins and dropping a new roll bar from a roll bar magazine into the bearing troughs and returning the guiding element; securing the new roll bar by pressing the bearing pins into ends of the roll bar with release of the drive shaft and with extension of the product entraining needles from the roll bar; simultaneously returning the shielding element and releasing the drive shaft til abutment against the new roll bar; and starting again the circular knitting machine with a slow pace til a starting portion of a knitting hose is engaged by the new roll bar, and then switching to an operational speed.

* * * * *

UNITED STATES PATENT AND TRADEMARK OFFICE

CERTIFICATE OF CORRECTION

PATENT NO. : 4,888,963

DATED : December 26, 1989

INVENTOR(S) : Werner Scherzinger, et al

It is certified that error appears in the above-identified patent and that said Letters Patent is hereby corrected as shown below:

On the title page:

In the heading [75] the place of residence of the applicant Paul Neher should read:

-- Messstetten --;

In the heading [73] the name of the assignee should read --SIPRA PATENTENTWICKLUNGS- UND BETEILIGUNGSGESELLSCHAFT MBH TAILFINGEN ,FED.REP.OF GERMANY--

Signed and Sealed this

Twenty-ninth Day of January, 1991

*Attest:*

*Attesting Officer*

HARRY F. MANBECK, JR.

*Commissioner of Patents and Trademarks*